US006776633B2

(12) United States Patent
Lo et al.

(10) Patent No.: US 6,776,633 B2
(45) Date of Patent: Aug. 17, 2004

(54) MODIFIED MALE CONNECTOR ON INTERNAL POWER SUPPLY CORD

(76) Inventors: Ding-Ea Lo, 2F, No. 7, Alley 41, Lane 458, Pei-An Rd., Taipei (TW); Jung-Yung Ho, No. 15, Lane 105, Ping-Ching St., Taipei (TW)

( * ) Notice: Subject to any disclaimer, the term of this patent is extended or adjusted under 35 U.S.C. 154(b) by 0 days.

(21) Appl. No.: 10/291,698

(22) Filed: Nov. 12, 2002

(65) Prior Publication Data

US 2004/0092155 A1 May 13, 2004

(51) Int. Cl.[7] ..... H01R 13/62
(52) U.S. Cl. ..... 439/160
(58) Field of Search ..... 439/159, 160

(56) References Cited

U.S. PATENT DOCUMENTS 4,140,359 A * 2/1979 Kunz ..... 439/160
4,531,795 A * 7/1985 Sinclair ..... 439/152
4,619,492 A * 10/1986 Corblick ..... 439/153
5,380,213 A * 1/1995 Piorunneck et al. ..... 439/160
5,676,556 A * 10/1997 Yamaguchi et al. ..... 439/157

* cited by examiner

*Primary Examiner*—Lynn Feild
*Assistant Examiner*—Phuong Dinh
(74) *Attorney, Agent, or Firm*—Troxell Law Office PLLC

(57) ABSTRACT

A modified male connector on an internal power supply cord of a personal computer is provided. The modified connector enables easy unplugging of the connector of the power supply cord from the female connector of an electronic device. The invention is characterized in that two compressible tabs are created on two opposing sides of the male connector. One end of the compressible tabs will be lined up touching against the outer rim of the female connector when the male connector is mated with the female connector. When unplugging the male connector, users have only to slightly depress the compressible tab, and male connector will be loosened and pushed out from the female connector.

1 Claim, 4 Drawing Sheets

MODIFIED MALE CONNECTOR ON INTERNAL POWER SUPPLY CORD

BACKGROUND OF THE INVENTION

1. Field of the Invention

The present invention relates to a modified male connector on the internal power supply cord, in particular to a structural modification on the drive power connectors that facilitates the unplugging of the power supply cord from the electronic device.

2. Description of Related Arts

All electronic devices inside a computer, such as CD/DVD drives, floppy drives, hard disk drives and blower fans, have to be connected to a switching power supply of the computer to obtain the necessary power. The switching power supply distributes the converted DC power through several power output terminals, which usually have a male connector attached to the end of an internal power supply cord. The electronic devices usually have female connectors at the back or on an extension for receiving the corresponding male connectors so as to draw the necessary power from the switching power supply.

A conventional female connector (40) as shown in FIGS. 6 and 7 has four metal pins (not shown in diagram) in parallel arrangement that provide +5V and +12V and grounds for the above-mentioned drives. A male connector (30) comes with four metal tubes (31), allowing the metal pins of the female connector (40) to be mated with the metal tubes (31) of the male connector (30), thus making electrical connection between the switching power supply and the internal drive through the connectors (30, 40).

A common practice is to create two bumps (32) on two opposing sides of the male connector (30) to facilitate unplugging of the male connector (30) attached on a power supply cord (33). The bumps (32) are designed to assist users in trying to get a firm grip on the male connector (30) while unplugging the power supply cord (33). This is to prevent breaking of the internal wire connection between the power supply cord (33) and the male connector (30) as the user tries to pull the power supply cord linking the male connector (30) and the female connector (40). However, the clipping force between the metal pins and the tubes (31) is strong such that it is not easy to pull out the male connector (30) even by tugging on to the bumps (32), not to mention that the fingers could slip from the male connector (30). The user often has to resort to grabbing of the power supply cord (33) in order to pull out the male connector (30), thereby possibly causing breaking of the internal wires.

The present invention is to address these problems with the conventional power connectors.

SUMMARY OF THE INVENTION

The main object of the present invention is to provide a modified male connector on the internal power supply cord of a personal computer that facilitates unplugging of the power supply cord from the female connector of an internal drive or a blower fan.

In the present invention, two compressible tabs are created on two opposing sides of the male connector. The compressible tabs will be pressed against the rim of the female connector as the male connector is mated with the female connector. When the user unplugs the male connector, he or she has only to depress the compressible tab slightly, by which the applied pressure is converted to a horizontal pushing force against the rim of the female connector. As a result, the male connector can be easily released from the female connector.

The present invention is characterized in that the structure of the male connector is modified with two compressible tabs created on two opposing sides of the male connector, and a pusher is formed at the free end of the compressible tab.

The present invention is also characterized in that the compressible tab extends from the fixed end of the male connector to the free end forming an arc-shape on the sides of the male connector.

The present invention is also characterized in that the outside surface of the compressible tab has a coarse texture.

The features and structure of the present invention will be more clearly understood when taken in conjunction with the accompanying drawings.

DETAILED DESCRIPTION OF THE PREFERRED EMBODIMENT

Two slightly different embodiments of the present invention will hereinafter be described in reference to the drawings.

Figure 1:
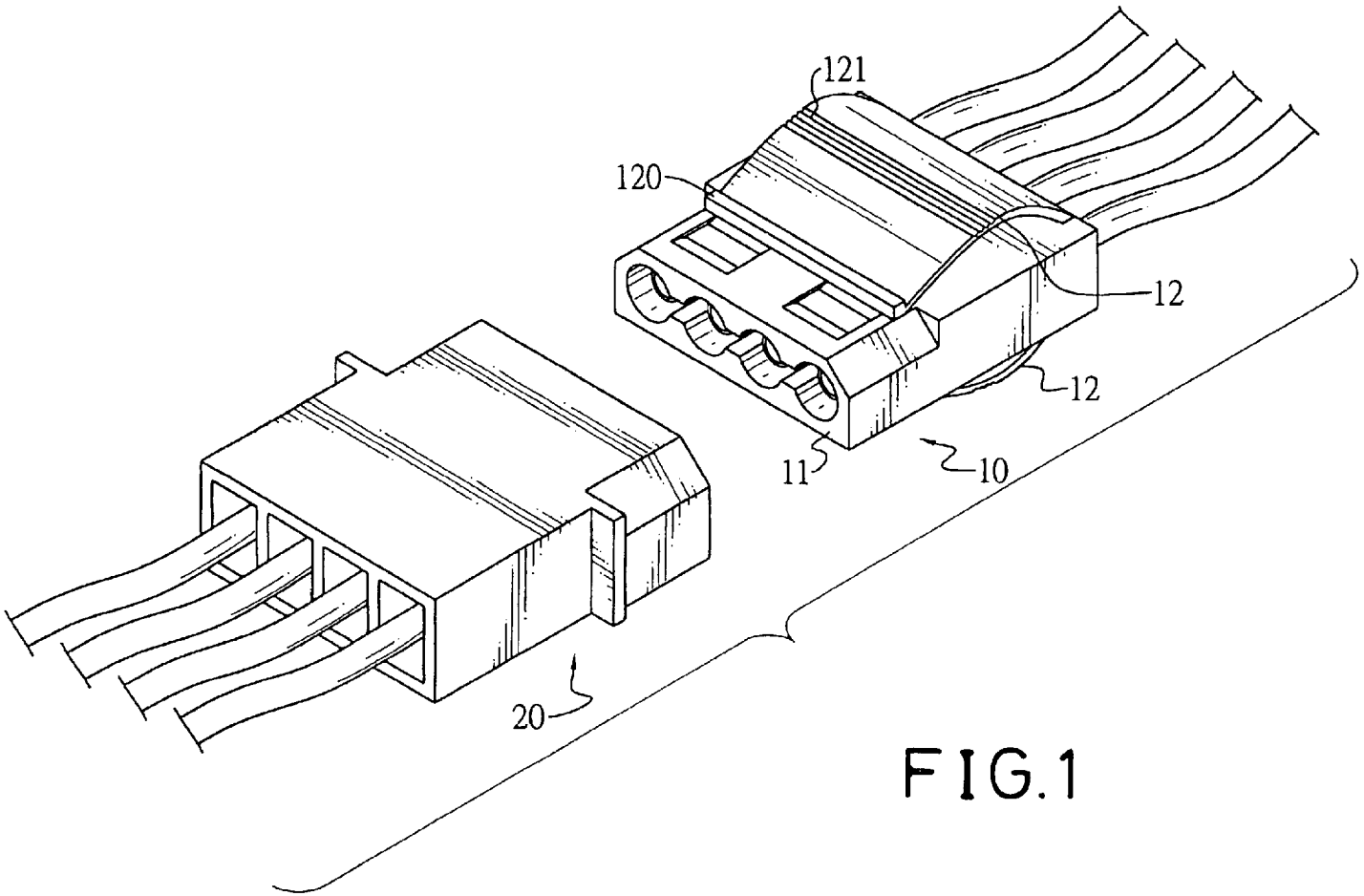
FIG. 1 is the perspective view of the modified structure of the male connector against a female counterpart.
Figure 2:
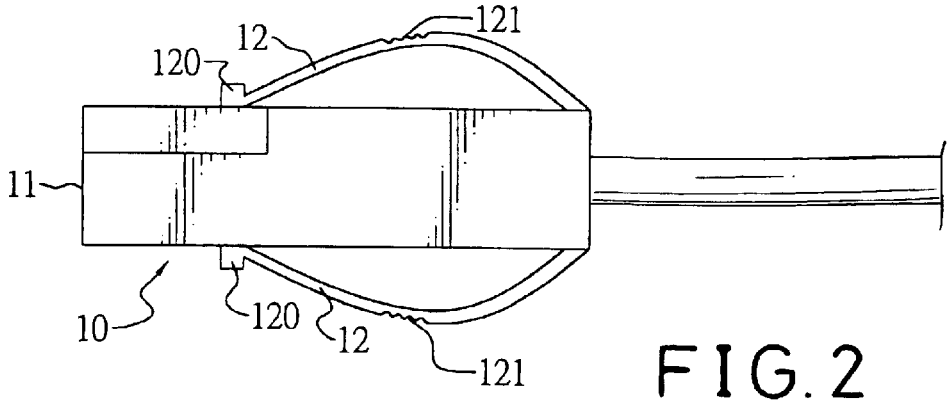
FIG. 2 is a side view of the first embodiment of the invention.

With reference to FIGS. 1 and 2, a modified male connector (10) in accordance with the invention has an engaging portion (11) at a front of the male connector (10), two compressible tabs (12) created on two opposing sides of the male connector (10), extending in the form of an arc from one end fixed on the male connector (10) to pusher (120) at a free end thereof. As the tabs (12) are identical in form and function, reference thereto herein after is in the singular. The pusher (120) is to correspond to the outer rim of a female connector (20) when the connectors (10, 20) are mated. The outside surface of the compressible tab (12) has coarse texture (121).

Figure 3:
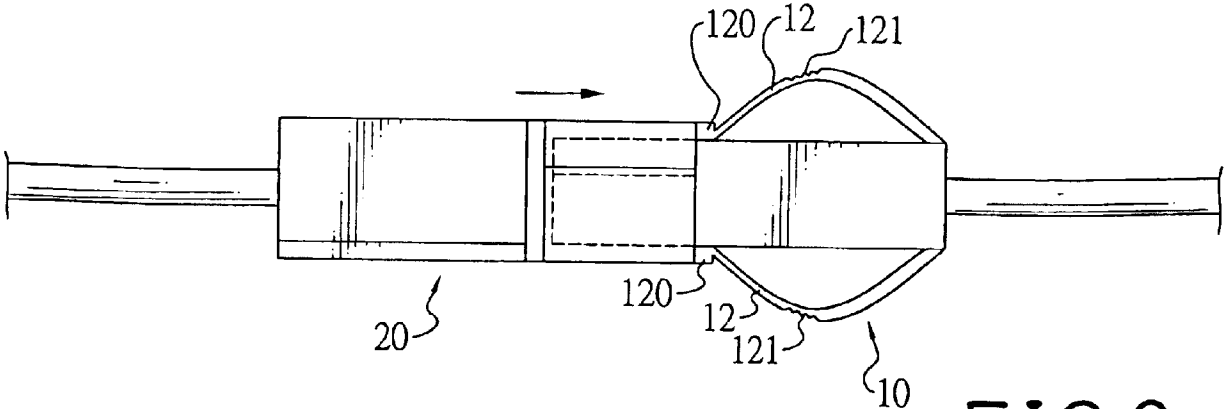
FIG. 3 is a side view showing the modified male connector being mated with the female connector.
Figure 6:
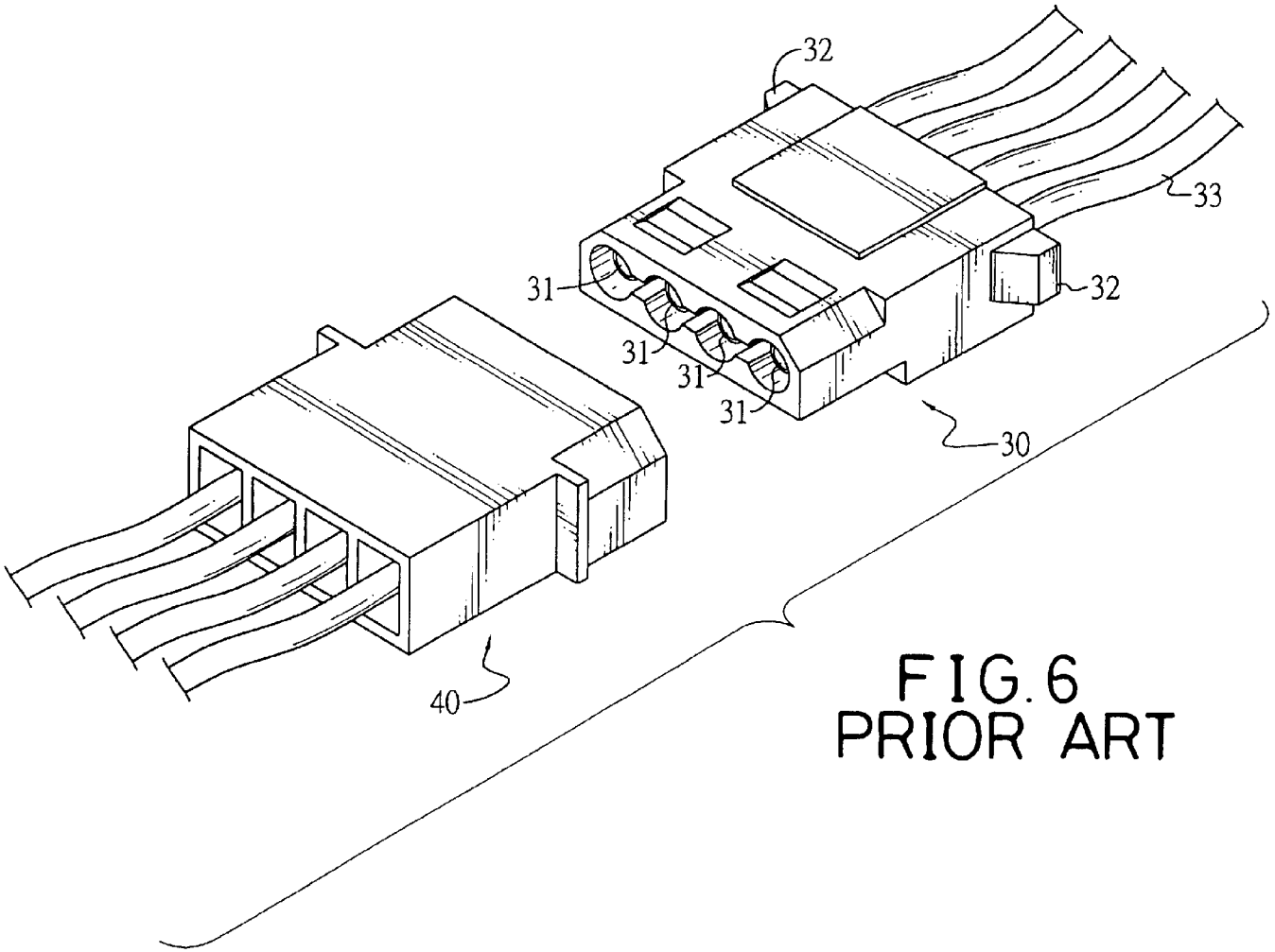
FIG. 6 PRIOR ART
FIG. 6 is a diagram of the conventional male connector and female connector.

With reference to FIG. 3, when the male connector (10) is mated with the female connector (20), the pusher (120) at the end of the compressible tab (12) is nudged against the outer rim of the female connector (20). Since one end of the compressible tab (12) is fixed on the male connector (10) whilst the other end is free but restricted by the connector body, the pressure applied on the compressible tab (12) is converted to horizontal force pushing against the rim of the female connector (20).

Figure 4:
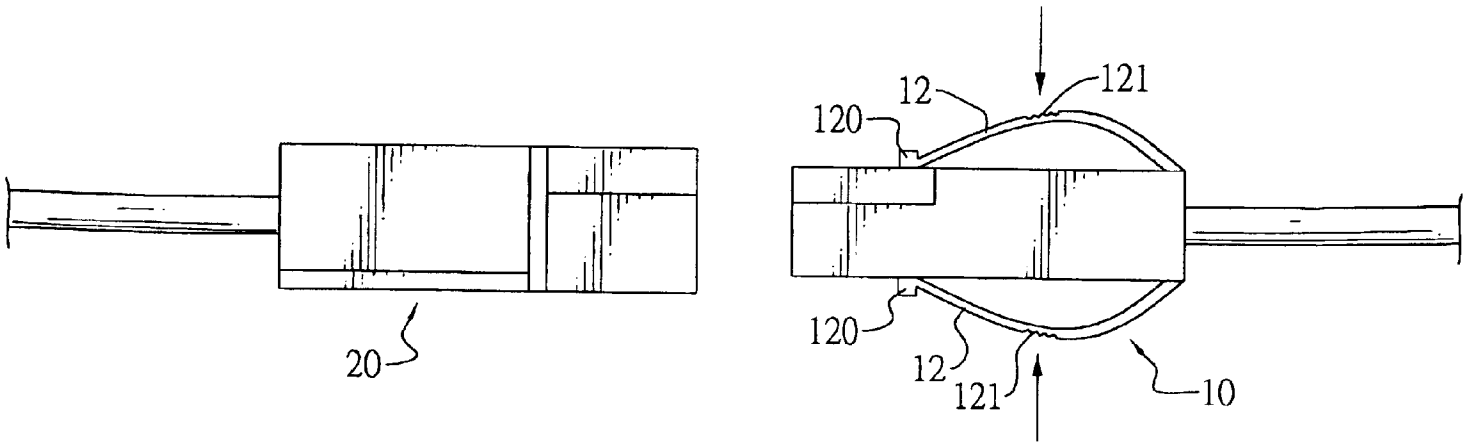
FIG. 4 is a side view showing the modified male connector being released from the female connector.

With reference to FIG. 4, when the user wants to unplug the male connector (10) from the female connector (20), he or she only has to slightly depress the compressible tab (12) on the male connector (10), whereafter the pusher (120) is pushed against the outer rim of the female connector (20), forcing out the male connector (10) by the counter pressure from the female connector (20).

Figure 5:
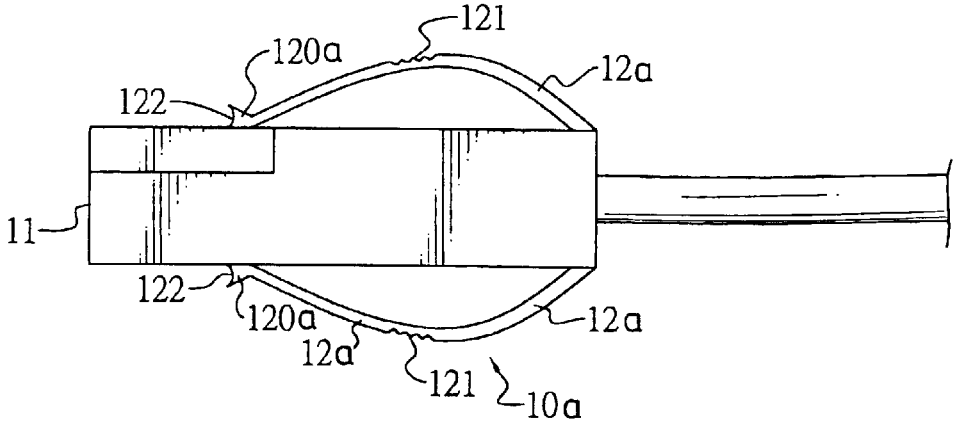
FIG. 5 is a side view of the second embodiment of the invention.
Figure 7:
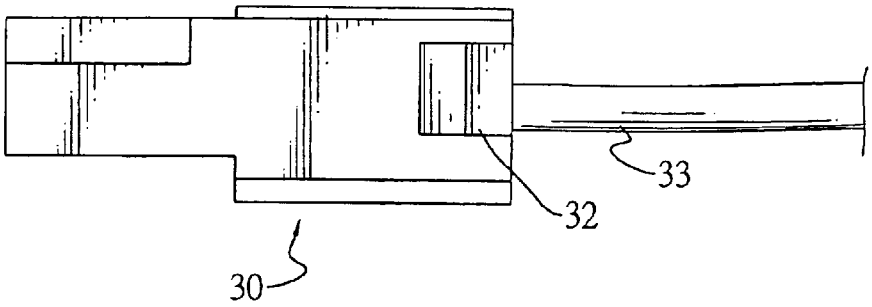
FIG. 7 PRIOR ART
FIG. 7 is a side view of the structure of a conventional male connector.

With reference to FIG. 5, in the second embodiment of the invention, to prevent the pusher (120*a*) slipping off from the rim of the female connector (20) during the physical connection of the male connector (10*a*) and the female connector (20), the compressible tab (12*a*) is designed with a recess (122) on the outside edge of the free end for holding the pusher (120*a*) in position. This structural design on the free end of the compressible tab (12*a*) can restrict the movement of the pusher (120*a*) only toward a given direction, ensuring proper alignment of the position of the pusher (120*a*) of the male connector (10*a*) against the female connector (20).

Again referring to FIG. 1, to enhance the gripping force on the compressible tab (12), the outside surface of the compressible tab (12) has coarse texture (121), which can be in granulated, embossed, corrugated or roughened texture to increase the frictional force between the user's fingers and the surface of the compressible tab (12).

The foregoing description of the preferred embodiments of the present invention is intended to be illustrative only and, under no circumstances, should the scope of the present invention be so restricted.

What is claimed is:

1. A male connector removably connected in a female connector and including a body comprising:

a) an engaging portion on a first end of the body;

b) a protruding portion on a second end of the body;

c) two compressible tabs having first ends thereof connected to opposing sides of the protruding portion and second ends thereof movably extending over opposing sides of the engaging portion, the two compressible tabs having curved shapes; and d) two pushers, one pusher formed on the second end of each of the two compressible tabs, wherein the two pushers engage an end of the female connector and are pushed towards the protruding portion of the male connector by the female connector thereby moving a center portion of each of the two compressible tabs away from the male plug when the engaging portion of the male connector is inserted into the female connector, the male connector is separated from the female connector by pressing the center portion of each of the two compressible tabs toward the male plug such that a separating force is applied on the female connector by the two pushers; the center portion of each of the two compressible tabs has a course texture; and each pusher has an arcuate recess.

* * * * *